US008180254B2

(12) United States Patent
Bonacci et al.

(10) Patent No.: US 8,180,254 B2
(45) Date of Patent: May 15, 2012

(54) DYNAMIC IMAGE POSITIONING AND SPACING IN A DIGITAL PRINTING SYSTEM

(75) Inventors: Andrew J Bonacci, Webster, NY (US); Jonathan B Hunter, Marion, NY (US); David M Kerxhalli, Rochester, NY (US); David R Kretschmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 449 days.

(21) Appl. No.: 12/511,279

(22) Filed: Jul. 29, 2009

(65) Prior Publication Data

US 2011/0026950 A1 Feb. 3, 2011

(51) Int. Cl.
*G03G 15/00* (2006.01)

(52) U.S. Cl. ..... 399/162; 399/38; 399/107

(58) Field of Classification Search ..... 399/107, 399/160, 162, 301, 299, 306, 396
See application file for complete search history.

(56) References Cited

U.S. PATENT DOCUMENTS 7,519,314 B2 4/2009 Carolan
2006/0233569 A1* 10/2006 Furst et al. ..... 399/162

OTHER PUBLICATIONS

U.S. Appl. No. 12/388,101, filed Feb. 18, 2009 by Ana P. Tooker et al, "Controlling Sheet Registration in a Digital Printing System".
U.S. Appl. No. 12/491,307, filed Jun. 25, 2009 by Andrew James Bonacci et al, "Controlling Sheet Synchronization in a Digital Printing System".

* cited by examiner

*Primary Examiner* — David Gray
*Assistant Examiner* — Roy Y Yi

(57) ABSTRACT

A dynamic positional shifting, in the process direction, of the images on the second print engine of a tandem machine printing system in order to increase the time (and number of prints) between skipped pitches. Although the photoreceptor belts of each print engine may be out-of-phase, the relative positions of their individual seam zones may be derived during cycle-up. A control procedure then optimizes the position and spacing of each image within each belt revolution of the second engine, while still maintaining the minimum inter-document zone (IDZ) length required for paper path feeding and registration, xerographic process controls, and finishing. Removing the constraints of fixed-dimension IDZ's, as well as being able to adjust spacing and length of individual images on the belt, allows for optimization of system productivity by either delaying or eliminating the need for a skipped pitch.

11 Claims, 4 Drawing Sheets

DYNAMIC IMAGE POSITIONING AND SPACING IN A DIGITAL PRINTING SYSTEM

BACKGROUND

1. Field of the Technology

The present disclosure relates to digital printing systems having plural tandem marking or printing engines of the type with seamed photoreceptor (P/R) belts. In such printing systems, it is common practice to invert the sheet after marking on one side in a first printing engine and for feeding the inverted sheet into a second printing engine for marking on the opposite side of the sheet to thus facilitate high speed duplex digital printing. In printing systems having plural tandem engines using photoreceptor belts with seams, it is necessary to avoid imaging on belt seams. This requires some manner of skipping pitches in order to avoid placing images on belt seams. However, skipping pitches adversely affects printer efficiency.

2. Description of the Prior Art

A general manner of belt synchronization to avoid seams, showing the control of the belt speed of the marking devices to synchronize belts, is disclosed in U.S. No. Pat. 7,519,314 B2, assigned to the same assignee as the present invention. However, this technique is relatively inefficient in relation to the present disclosure. It is also shown in pending U.S. application Ser. No. 12/388,101, filed Feb. 18, 2009, now Publication No. 20100209161, by Ana P. Tooker et al, "Controlling Sheet Registration In A Digital Printing System", assigned to the same assignee as the present invention, to control sheet registration in a printing system by varying the dwell time of a sheet in an inverter in a first marking device and changing various transport motor speeds to time the arrival of the sheet at a second marking device. However, there is no disclosure of the need to synchronize the belts for efficient avoidance of belt seams for the productivity of the printing process. With the speeds of the two PR's no longer synchronized, the seam zones of said PR's are no longer in phase. With no understanding of the relative position of the two seam zones to each other, skipped pitches may occur in a non-optimal manner impacting customer productivity. Seam synchronization is also shown in U.S. application Ser. No. 12/491,307, Publication No. 20100329742, now abandoned, assigned to the same assignee as the present invention, filed Jun. 25, 2009 by Andrew James Bonacci et al, "Controlling Sheet Synchronization in a Digital Printing System"; and U.S. Continuation-in-Part application Ser. No. 13/225,744, filed Sep. 06, 2011 of the same title, by the same inventor and assigned to the same assignee as the present invention. However, neither this application nor the prior art accounts for efficient spacing of images on PR's to adjust to different image sizes or print sheet sizes in the printing system.

SUMMARY OF DISCLOSURE

This disclosure is a dynamic positional shifting, in the process direction, of the images on the second print engine, in a tandem machine printing system in order to increase the time (and number of prints) between skipped pitches. Although the PR's of each print engine may be out-of-phase, the relative positions of their individual seam zones may be derived during cycle-up. A control procedure then optimizes the position and spacing of each image within each PR revolution, while still maintaining the minimum inter-document zone (IDZ) length required for paper path feeding and registration, xerographic process controls, and finishing. Removing the constraints of fixed-dimension IDZ's, as well as being able to adjust spacing and length of individual images on the belt, allows for optimization of system productivity by either delaying or eliminating the need for a skipped pitch. Further features and advantages will be apparent to those skilled in the art from the specific apparatus and its operation or methods described in the example(s) below, and in the claims. Thus, they will be better understood from this description of these specific embodiments including the drawing figures wherein:

DETAILED DESCRIPTION OF DISCLOSURE

Figure 1:
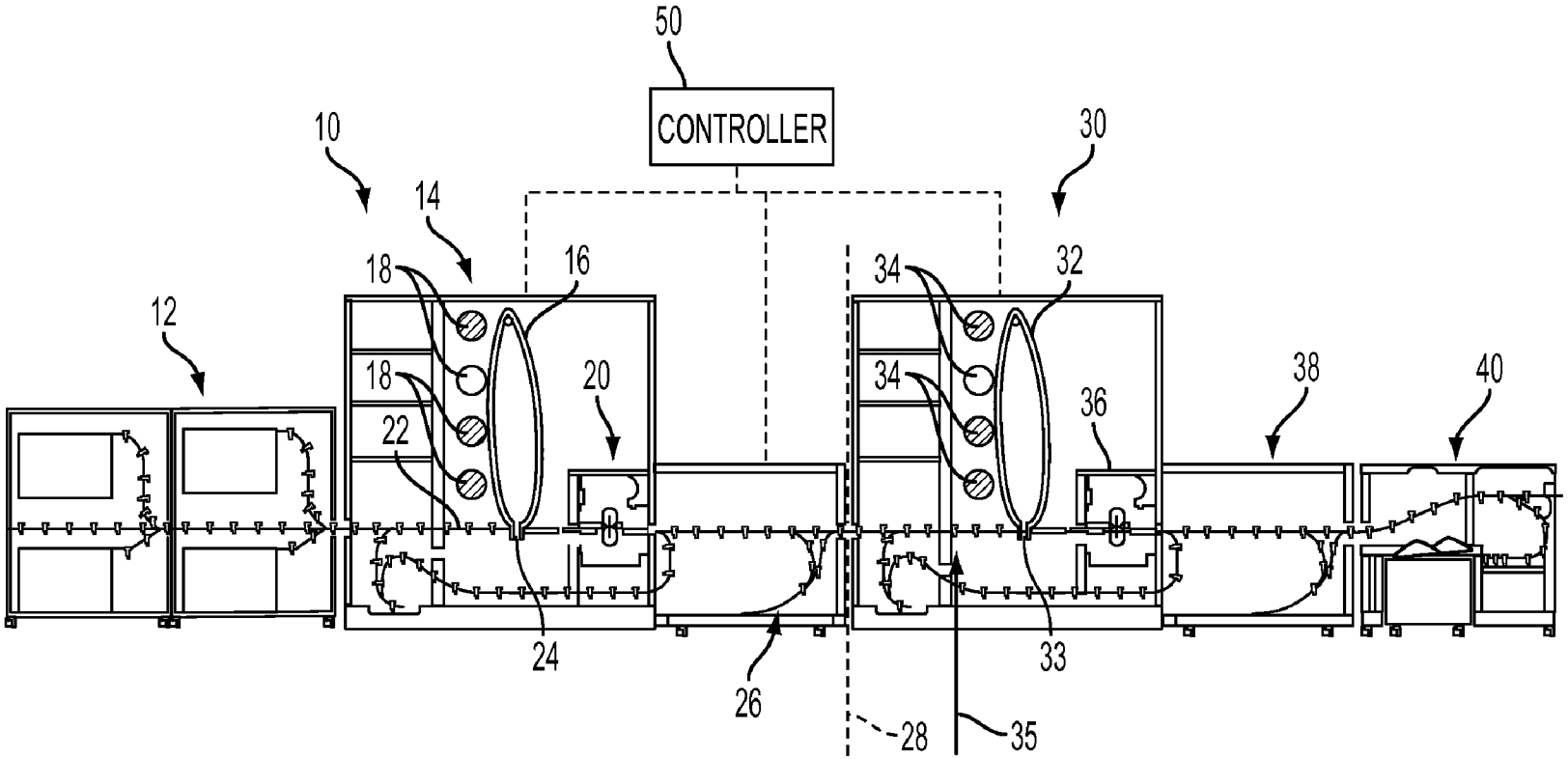
FIG. 1 is a schematic of an exemplary digital printing system having tandem marking engines.

With reference to FIG. 1, a digital printing system according to the present disclosure is indicated generally at 10 and includes a sheet feeder assembly indicated generally at 12, a first marking engine indicated generally at 14 including a P/R belt 16 and a plurality of colorant generators 18 for a color image formation on the belt 16. The marking engine 14 includes a fuser 20 and a transport path 22 through the marking engine. The P/R belt 16 is operative to transfer the image to the first side of sheet stock on path 22 at a transfer station indicated by reference numeral 24. From the marking engine at station 24, the sheet stock is advanced along path 22 and discharged from fuser 20 to an inverter 26 which inverts the marked sheet and maintains the sheet for a controlled dwell time before reentry onto path 22 and movement to the entrance station 28 for the second marking engine indicated generally at 30.

The sheet stock is controlled to arrive at the registration point indicated by the arrow and denoted by reference numeral 35 in marking engine 30 at a controlled time. The second marking engine 30 includes a P/R belt 32 and has colorant generators 34 for forming a color image on the P/R belt 32. It should be understood that the belts 16 and 32 include seams and that imaging on the seams of either belt is to be avoided to insure image quality. The P/R belt 32 is operative to transfer the color image to the second side of a sheet at a transfer station indicated by reference numeral 33. The marking engine 30 also includes a post marking fuser 36. The sheet is then conveyed to a second inverter 38 which restores the sheet to its original orientation and discharges the duplex marked sheet to a finisher 40.

The system of FIG. 1 includes a controller 50 connected as indicated by dashed lines for controlling the marking engines 14 and 26.and the inverter 26. The controller 50 generally monitors the position of the seams of P/R belts 16 and 32 by means of any suitable sensor (not shown). For example, a hole in a P/R belt can be sensed to identify the location of the seam.

Figure 2:
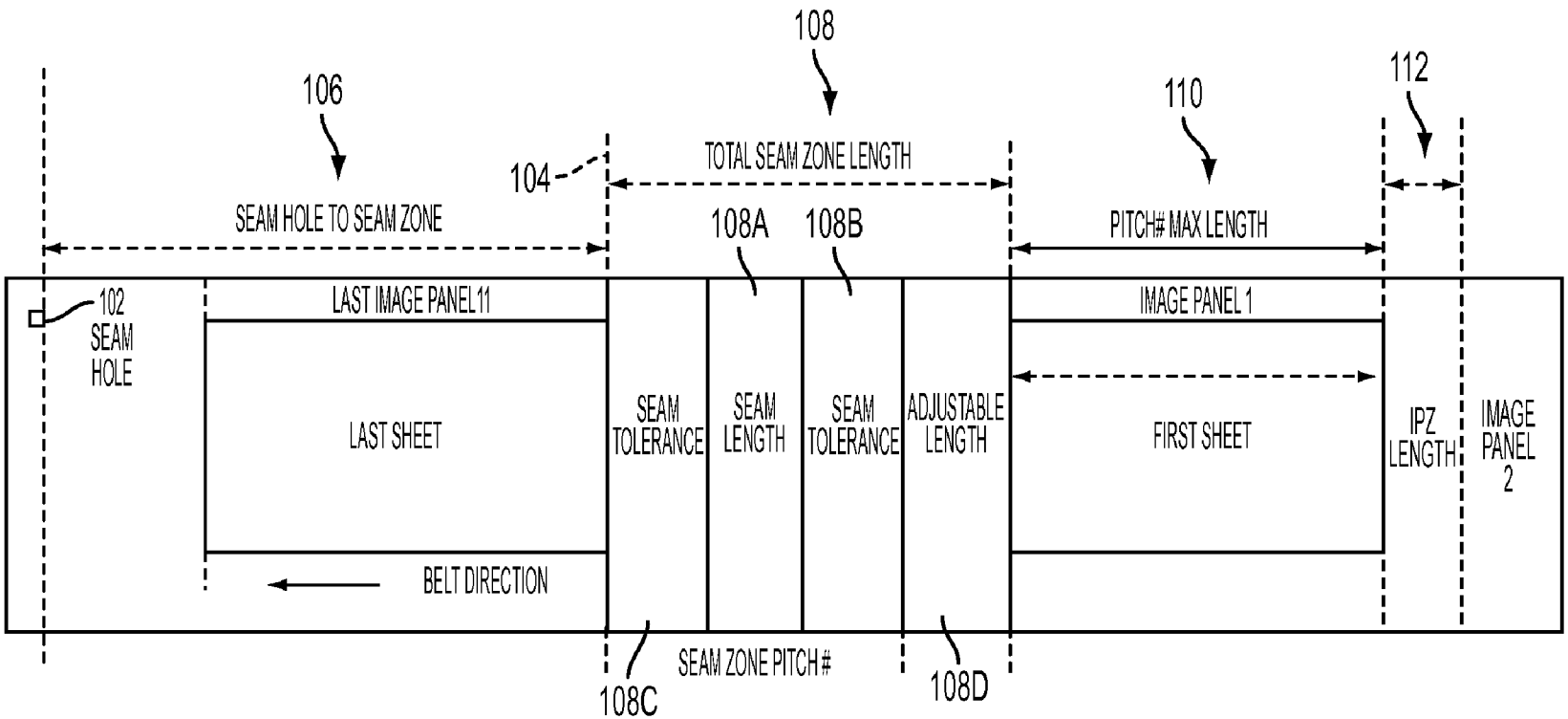
FIG. 2 is an illustration of the dimensions that are dynamically shifted in the control of a printing system in accordance with the present disclosure.

With reference to FIG. 2, there is an illustration of the process dimensions that are described in the present disclosure to adjust the spacing and position of the images on the belt of engine 2. In particular, four dimensions will be described that can be used. It should be understood that this disclosure is not limited to the dimensions discussed, but that other measures of a printing system are contemplated within the scope of this disclosure.

The first dimension is the distance from the trail edge of the hole 102 in the belt to the lead edge of the seam zone 104 of the belt of engine 2 as shown at 106. This distance includes the length of the last image panel on the belt to the location of the belt hole. The belt hole is sensed by a not shown sensor to provide the control with a location status of the belt, specifically, the location of the belt seam at each revolution of the belt.

Another dimension for adjustment is the total seam scan zone length illustrated at 108. This is defined as the length of the seam itself 108A with a fixed margin of error, or seam tolerance 108B and 108C on each side of the seam length 108A, and an adjustable length portion or variable margin 108D. The adjustable length portion 108D can be altered in relation to the image panel 1 dimensions.

A third dimension for adjustment is the pitch number maximum length illustrated at 110. There is a maximum length for images on the belt to satisfy an overall need for a minimum IPZ (inter-document zone) distance to insure proper paper path feeding and registration, xerographic process control, and finishing operations in a digital printing system. Never the less, adjustment of the length of selected image pitches is possible within given tolerances. Finally, the IPZ or inter-document length itself, illustrated at 112 can be adjusted, also, within certain tolerances.

This disclosure provides for dynamically shifting the images in the process direction on print engine 2 in order to increase the time (and number of prints) between skipped pitches. The control 50, as shown, optimizes the position and spacing of each image within each revolution of the belt of engine 2. Rather than being restricted by fixed dimensions for the image panels and the inter-document zones relative to the seam zone for all pitch modes, the control of this disclosure allows for both variable sizes and starting positions, relative to the seam zone, of all image panels and inter-document zones. This is done without disregarding the necessary constraints dictated by the xerographic process.

Figure 3:
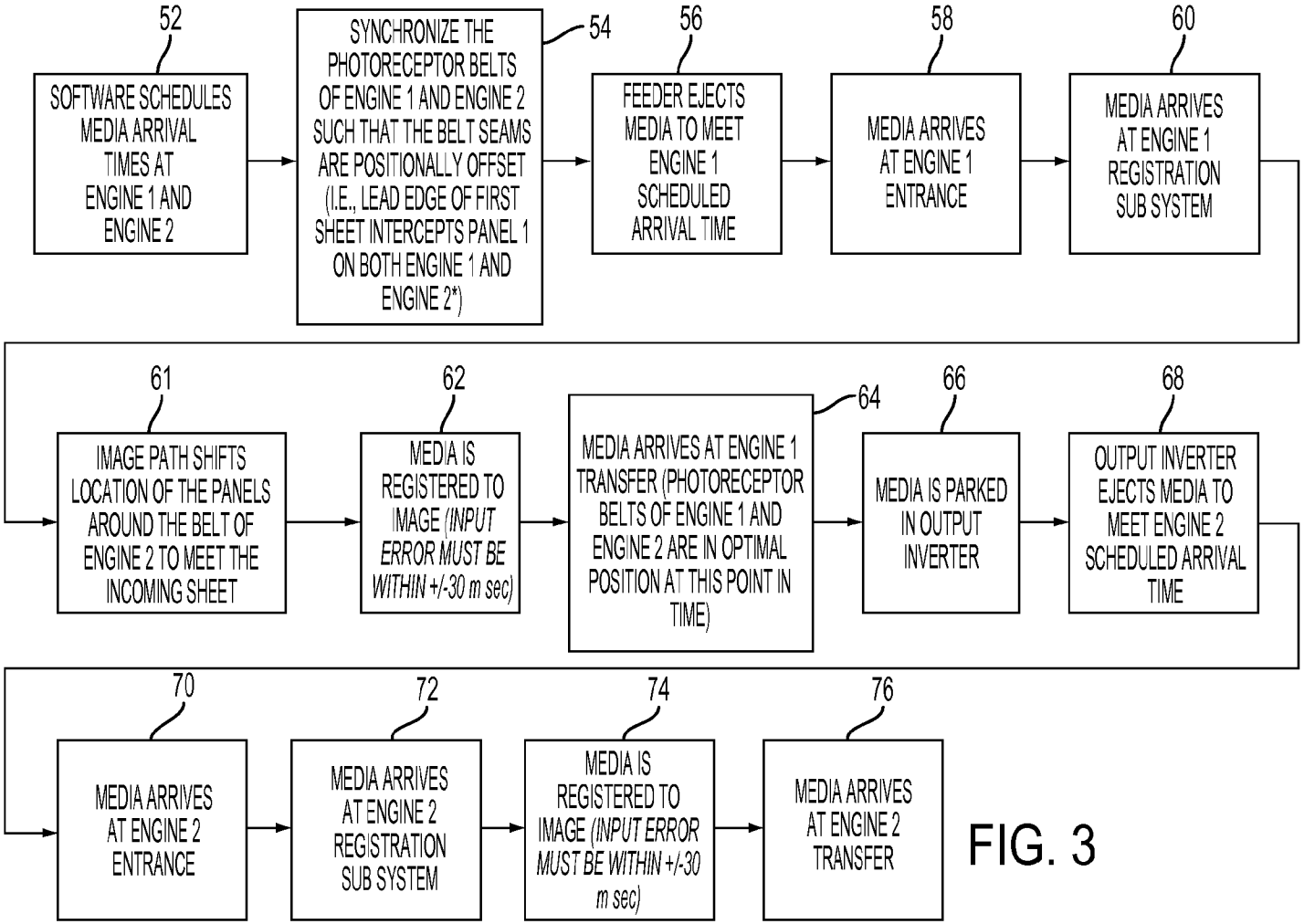
FIG. 3 is a flow diagram of the method of dynamic positional shifting of images in accordance with the present disclosure.

With reference to FIG. 3 there is a flow diagram of the dynamic positional shifting of images in accordance with the present disclosure. Shown in block 52, a suitable controller schedules media arrival times at engine 1 and engine 2. At block 54, there is illustrated the synchronization of the P/R belts of engine 1 and engine 2 such that the belt seams are relatively positioned for symmetrical printing, that is, the lead edge of first sheet intercepts panel 1 on both engine 1 and engine 2. Panel 1 is defined as the first panel following the photoreceptor belt seam in both engine 1 and engine 2. Block 56 demonstrates the operation of the feeder to eject a sheet to meet the engine 1 scheduled arrival time. As shown in block 58, the sheet arrives at the entrance to engine 1 and at block 60, there is illustrated the sheet arriving at the engine 1 registration subsystem.

At this point in the printing process, the belts of engines 1 and 2 have been synchronized to coordinate the belt seams and the relationship of image panels of engines 1 and 2 with the belt seams of engines 1 and 2. Accordingly, the controller of block 52 processes the seam hole to seam zone dimension, the seam zone pitch dimension, the maximum image length by pitch number dimension, and the inter-document zone length dimension. The control then shifts the location of the image panels around the belt of engine 2 to meet the incoming sheets in engine 2 as illustrated in block 61.

Next, block 62 illustrates the step of registration of the sheet with the image to be transferred to the sheet. At this point, the relationship of the arrival of the sheet at the transfer station with respect to the arrival of the image on the belt must be within a ±30 millisecond tolerance. At block 64, there is an illustration of the arrival of the sheet at the engine 1 transfer station for transfer of the image to the first side of a given sheet. It should be noted that at this point, the control has positioned the photoreceptor belts of engines 1 and 2 in optimal position with respect to the image panels on the belts with respect to the belt seams.

At block 66, the sheet has been parked or temporarily delayed in the engine 1 sheet output inverter. Block 68 shows the step of ejecting the sheet from the output inverter for conveyance to engine 2 at the scheduled arrival time and block 70 illustrates the arrival of the sheet at the engine 2 entrance. In block 72, the sheet arrives at the engine 2 registration system and at block 74 the sheet is registered to the image on the engine 2 belt. As with engine 1, the sheet registration tolerance of engine 2 for receiving a belt image is preferably within plus or minus 30 milliseconds. At block 76, finally, there is illustrated the transfer of the image from belt 2 of engine 2 to the second side of the given sheet.

Figure 4:
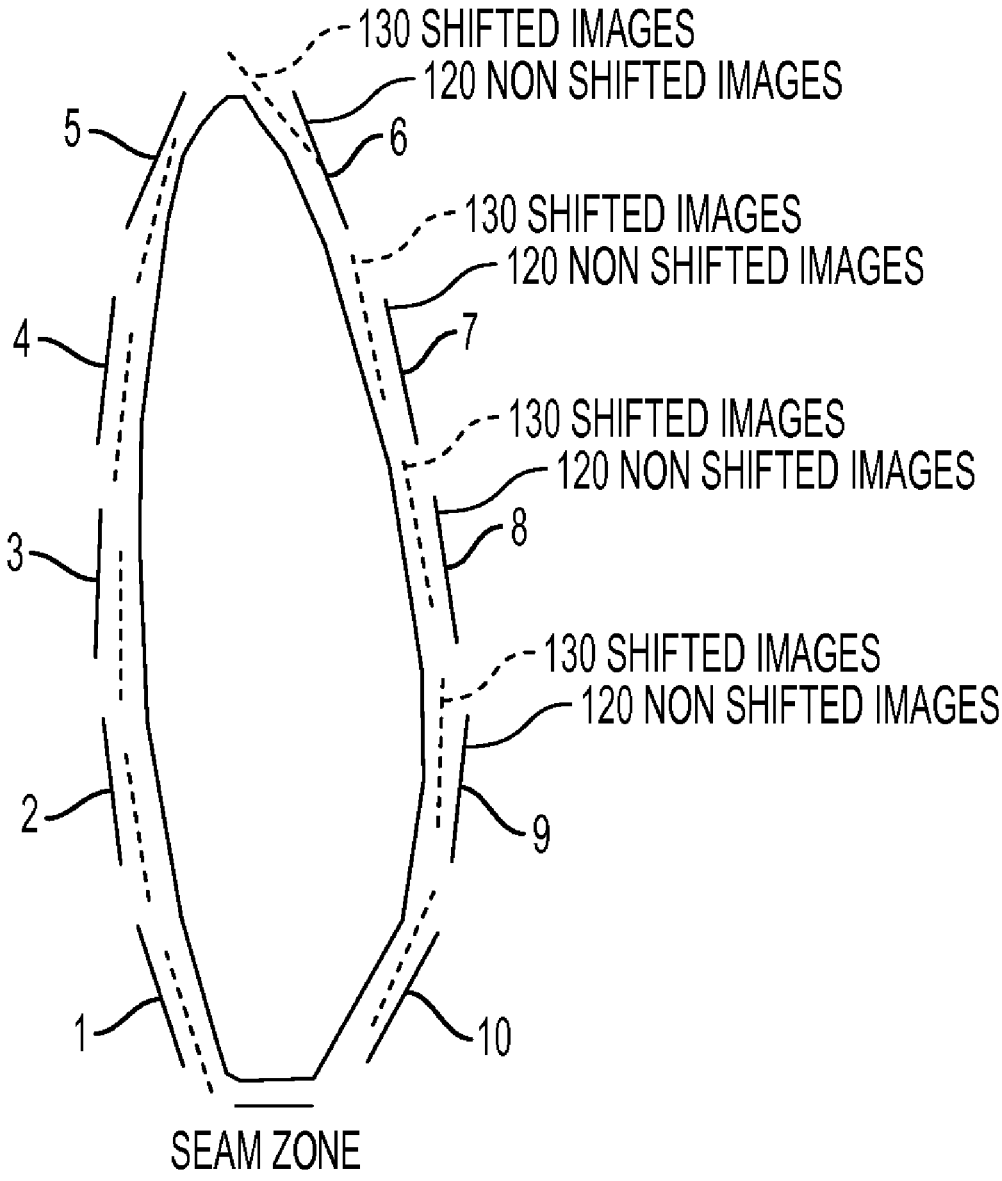
FIG. 4 is a general illustration of the shifting of images in the second engine of a tandem printing system in accordance with the present disclosure.

With reference to FIG. 4, there is a general illustration of the shifting of images in the second engine of a tandem printing system in accordance with the present disclosure. Instead of being restricted to set spacing and dimensions, image panel size could now be dynamically adjusted based upon the size of the sheets programmed in the stock library of a print station interface. Additionally, FIG. 4 depicts an example of how 10 image panels could be varied in the process direction to account for variation in the belt speeds. The solid lines 120 represent the numbered image panels (1-10) in a given first position that is a non-shifted position. The dashed lines 130 represent those same numbered image panels shifted in the process direction, the direction of the arrow. It should be noted that the shifting of an image can be selective. The degree of shift is based upon the size of an image and its particular location and relationship to the seam of the belt and to other images.

While similar in function to existing systems for the minor correction of image drift, such systems are limited by close tolerances and do not change the size of the image panel or inter-document zones. In the present disclosure, the system is able to change the size of the image panel or IDZ's. Feedback from the PR Belt Controller can be used to understand the drift between the seams of the two PR Belts. This information can be used to shift the image positions on the next belt revolution so that the paper will continue to arrive at the second engine within the allocated time window for proper registration at transfer.

It should also be apparent that while specific embodiments of the present disclosure have been illustrated and described, it will be understood by those having ordinary skill in the art to which this invention pertains, that changes can be made to those embodiments without departing from the spirit and scope of the disclosure. Further, The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, or position.

What we claim is:

1. In a printing system having first and second printing engines, the engines including imaging belts with seams, the first printing engine printing on a first side of a sheet, the second printing engine printing on the second side of the sheet, a method of synchronizing the printing on the second side of a sheet comprising the steps of:

projecting first images on the imaging belt of the first engine, the images having a predetermined relationship with the seam of the belt of the first engine, transferring the first images to a first side of the sheets, the sheets having a given size, monitoring predefined dimensions on the belt of the second printing engine, and adjusting the position of the images projected onto the belt of the second printing engine in response to the monitored predefined dimensions, wherein the step of adjusting the position of the images projected onto the belt of the second printing engine in response to the monitored predefined dimensions includes the steps of shifting the images on the belt of the second printing engine in the direction of movement of the belt and adjusting the position of the images during each cycle of the belt while maintaining a minimum inter-document zone, in order to increase the time between skipped pitches.

2. The method of claim 1 wherein the predefined dimensions include a relationship of the length along the belt of the belt hole to the seam zone and a relationship to belt seam length.

3. The method of claim 1 wherein the predefined dimensions include a relationship to the maximum length of given image pitches and a relationship to inter-document zone length.

4. The method of claim 1 wherein one of the predefined dimensions is a relationship to the size of the sheets.

5. In a printing system having first and second printing engines, the first printing engine printing on a first side of a sheet, the second printing engine having a belt and seam and printing on the second side of the sheet, a method of synchronizing the printing on the second side of a sheet comprising the steps of:

projecting first images on the imaging belt of the first engine, transferring the first images to a first side of the sheets, the sheets having a given size, and providing variable starting positions of the images projected onto the belt of the second printing engine in response to the variation of the size of the sheets, including the step of monitoring predefined dimensions on the belt of the second printing engine, the predetermined dimensions including a relationship to the maximum length of given image pitches, a relationship to the belt seam length and a relationship to the inter-document zone length to increase the time between skipped pitches.

6. The method of claim 5 wherein one of the predefined dimensions on the belt of the second printing engine is a relationship to the length along the belt from the belt hole to the seam zone.

7. A dynamic positional shifting of the images on a second print engine of a tandem machine printing system having first and second imaging surfaces with seams in order to increase the number of prints between skipped pitches comprising the steps of:

determining the relative position of the seams of the imaging surfaces of the printing system, monitoring the spacing tolerance for images on the second imaging surface, and adjusting the position of images on the second imaging surface, wherein the step of adjusting the position of the images on the second imaging surface includes the steps of shifting the images on the second imaging surface in the direction of movement of the belt and adjusting the position of the images during each cycle of the belt while maintaining a minimum inter-document zone.

8. The method of claim 7 wherein the step of adjusting the position of images on the second imaging surface including the step of adjusting the position of images within each imaging surface revolution.

9. The method of claim 7 including the step of adjusting the spacing between images on the second surface while maintaining a minimum inter-document zone length required for the tandem machine printing system.

10. The method of claim 1 including the step of removing the constraints of fixed-dimension inter-document zones on the belt of the second printing engine, as well as being able to adjust spacing and length of individual images on said belt, allowing for optimization of system productivity by delaying the need for a skipped pitch.

11. The method of claim 5 including the step of shifting the position of the image relative to the belt seam of the second pint engine, in order to extend the number of belt revolutions of the second print engine before the need to skip a pitch.

* * * * *